United States Patent [19]

Pietro

[11] Patent Number: 4,858,089

[45] Date of Patent: Aug. 15, 1989

[54] LIGHTING FIXTURE HAVING IMPROVED HEAT DISSIPATION CHARACTERISTICS

[75] Inventor: Michael S. Pietro, Staten Island, N.Y.

[73] Assignee: Eastrock Technology, Inc., Hackettstown, N.J.

[21] Appl. No.: 127,472

[22] Filed: Dec. 2, 1987

[51] Int. Cl.[4] ..... F21V 29/00

[52] U.S. Cl. ..... 362/294; 362/373; 362/345; 313/493

[58] Field of Search ..... 362/294, 217, 345, 373, 362/260; 313/33-35, 493; 315/112

[56] References Cited

U.S. PATENT DOCUMENTS

| | | | |
|---|---|---|---|
| 2,016,474 | 10/1935 | Wood | 362/294 |
| 4,004,143 | 1/1977 | Good et al. | 362/294 |
| 4,497,016 | 1/1985 | Sachse | 362/294 |
| 4,503,358 | 3/1985 | Kamei et al. | 313/493 |
| 4,503,360 | 3/1985 | Bedel | 362/373 |
| 4,723,200 | 2/1988 | Troen | 362/260 |

FOREIGN PATENT DOCUMENTS

| | | | |
|---|---|---|---|
| 698909 | 2/1931 | France | 362/294 |
| 8602986 | 5/1986 | PCT Int'l Appl. | 362/294 |

*Primary Examiner*—Ira S. Lazarus
*Assistant Examiner*—D. M. Cox
*Attorney, Agent, or Firm*—Fitzpatrick, Cella, Harper & Scinto

[57] ABSTRACT

A lighting fixture, e.g., lamp holder, to allow fluorescent and other non-incandescent lamps to be operated from incandescent sockets or from line voltage, with satisfactory heat dissipation, even at higher wattages. The fixture is structured to cause air to circulate through the holder so as to dissipate heat generated during operation of a lamp in the fixture. A radiative heat dissipator may also be provided to improve cooling still more.

20 Claims, 1 Drawing Sheet

LIGHTING FIXTURE HAVING IMPROVED HEAT DISSIPATION CHARACTERISTICS

BACKGROUND OF THE INVENTION

1. Field of the Invention

The present invention pertains to lighting fixtures, and more particularly to adapters and other fixtures for holding fluorescent and other non-incandescent lamps and allowing such lamps to be operated on line voltage supplied, e.g., by an incandescent light socket.

2. Description Of The Related Art

It is well known that many lamps exist which have a higher light-generating efficiency than incandescent bulbs. For example, fluorescent lamps, magnetic or solid state halogen lamps, and magnetic or solid state H.I.D. lamps each generate more light for a given consumption of power than do incandescent bulbs. Nevertheless, the use of incandescent light sockets prevails in most existing buildings and incandescent light sockets continue to be installed even in many newly-constructed buildings. Thus, an adapter which allows different lamps to be operated from an incandescent light socket is desirable from the view point of economy.

Adapters which allow fluorescent lamps to be operated from an incandescent light socket are known. One type of fluorescent lamp used with such adapters is of an elongated U-shape, the base of the lamp having a pair of electrical pin connectors, one on either side of a depending starter housing. Adapters for this and other types of fluorescent lamps have a screw-type socket base for insertion into an incandescent socket, and contain pin receptacles for accepting the pin connectors of the fluorescent lamp. A ballast or solid state regulation circuit is provided in the adapter to control current in a well known manner, and may be annular in shape and mounted so as to surround some portion of the lamp when the latter is received in the adapter.

However, the characteristics peculiar to an incandescent application place operational constraints on the fluorescent adapter, and have heretofore limited the power rating or maximum wattage of the fluorescent lamp. This limitation is directly traceable to the heat generated during operation of the fluorescent lamp in the adapter.

Heat is generated both by the fluorescent lamp and by the ballast (or regulation circuit) within the adapter. The lamp generates heat due to power losses during the generation of light. An inductive ballast generates heat due to power losses caused by eddy currents induced in the metal core of the ballast by changing magnetic flux. While the core of such a ballast is normally laminated to interrupt these eddy currents, power losses in the ballast core are nevertheless substantial and result in significant heat generation. Similarly, power losses in regulation circuits (e.g., $I^2R$ losses) result in significant heat generation.

Thus, heat generated by the fluorescent lamp and adapter places an upper limit on the maximum power rating of the fluorescent lamp which can be used practically in a standard incandescent fixture. Moreover, heat generated even in practicable applications can limit the life of both the fluorescent lamp and the adapter by contributing to the breakdown of these items.

The physical arrangement of the adapter in particular applications can also further exacerbate the problems caused by excessive heat. It may be desired to use such an adapter in a ceiling fixture such as the type known as a "high hat". In such an application, the adapter would be placed at the top of a reflector arranged to direct light down into a room. The internal physical dimensions of the reflector limit the size of an adapter which may be utilized and the adapter must therefore be designed to make efficient use of the space available within the high hat. Heat generated by the adapter and the lamp is therefore confined and concentrated at the upper portion of the reflector, precisely where the adapter is located. The heat has a direct and severe impact on the proper operation of the adapter, and limits both the power rating of the fluorescent lamp and the life of the lamp and the adapter.

These and other drawbacks of excessive heat within a fluorescent, or other, lamp assembly are overcome by my invention.

SUMMARY OF THE INVENTION

It is therefore an object of my invention to increase the amount of heat dissipated from a fluorescent lamp-/adapter assembly, to overcome the disadvantages caused by that heat.

In one aspect, my invention achieves its object by the provision of cooling means, e.g., air circulation means, on or in the housing of a fluorescent or other lighting fixture, such as an adapter, which may operate by allowing air to circulate through the housing and thereby to dissipate generated heat. In a preferred form, such an air circulation means includes vents within the adapter housing which allow heated air to pass through the vents and be replaced by cool air. The dissipation of heat allows the device to operate at lower temperatures than has hitherto been possible, thus allowing the use of higher wattage lamps and extending the life of both the lamp and adapter.

In a particularly preferred embodiment, such an adapter is mounted inside one end of a fixture (commonly referred to as a "high hat") recessed into a ceiling so that the lamp extends downward and projects light into the room. Such fixtures are a common choice for overhead or accent lighting. In such an application, the vents are preferably located at a peripheral area of the housing at an upper surface thereof. The vents may be located at a distance from the center of the housing which is radially between the annular ballast and the lamp. In this arrangement, a generally conical reflector is preferably provided on the adapter and serves, not only to concentrate and focus light from the lamp, but also as a chimney for heated air. As air is heated by operation of the adapter and is expelled through the vents, cooler air is drawn to the adapter through the reflector. This causes cool air to be drawn into the reflector and to circulate through the housing, thereby cooling both the ballast and the lamp. In addition, the reflector is preferably joined to the fixture body, in such a manner as to permit heat to pass conductively into the reflector, and to be radiated from there.

These and other features, objects and aspects of my invention will be more clearly and fully appreciated from a consideration of the accompanying drawings in conjunction with the following description of the preferred embodiment.

DESCRIPTION OF THE PREFERRED EMBODIMENT

Figures 1, 2, 3:
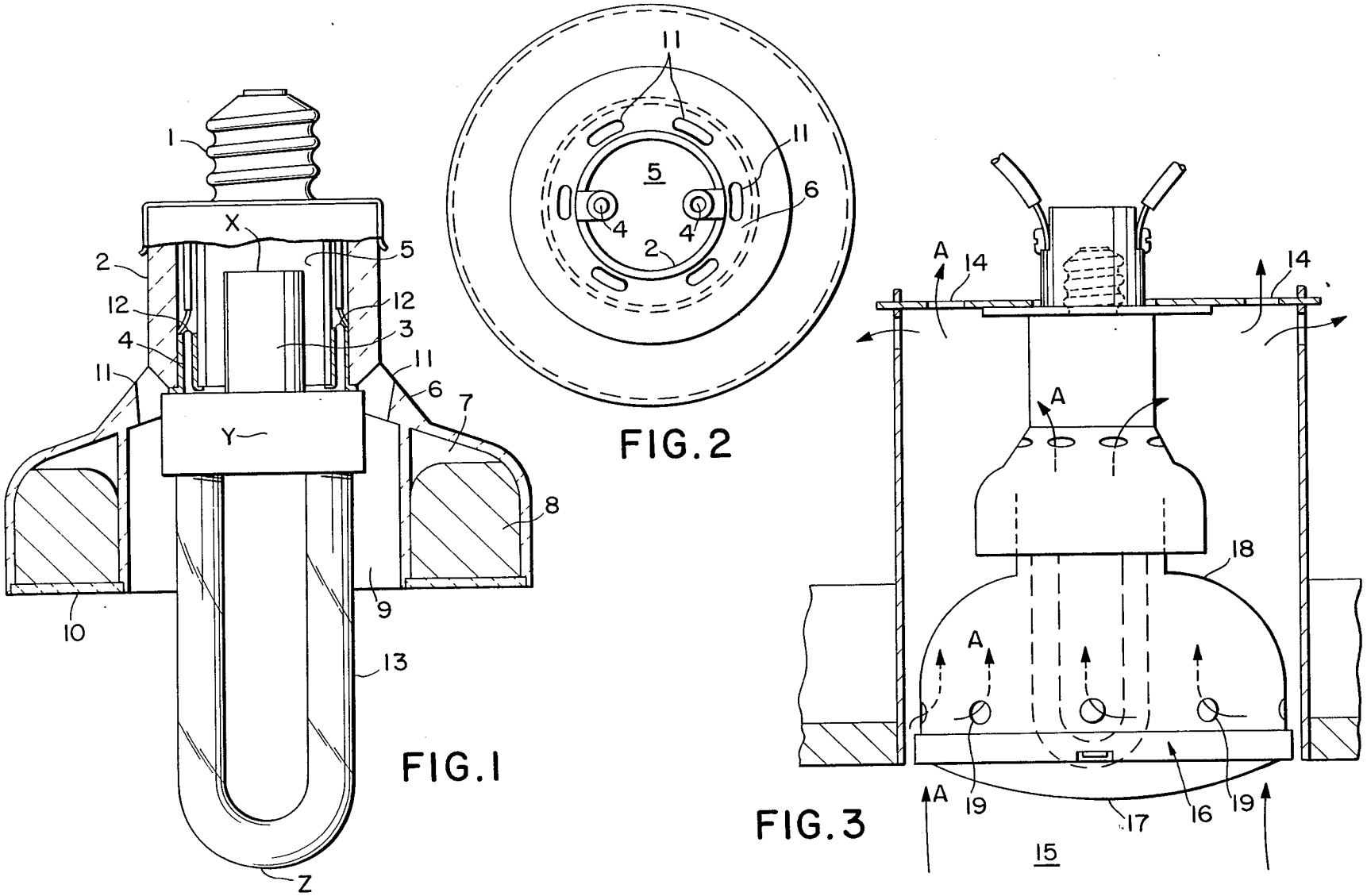
FIG. 1 is a cross-sectional view of a preferred embodiment of the adapter of my invention.
FIG. 2 is a top view of the embodiment of FIG. 1.
FIG. 3 is a cross-sectional view of the adapter of FIG. 1 in place within a conical reflector.

As shown in FIG. 1, it can be seen that in its preferred embodiment, the lighting fixture of the present invention is an adapter for enabling a non-incandescent lamp to be used with an incandescent socket. The adapter has a shape generally resembling that of an inkwell. Although any number of materials having suitable rigidity and resistance to heat may be utilized, valox plastic, being readily available and relatively inexpensive, is a particularly suitable material for the body of the adapter. The upper portion of the neck, as viewed in FIG. 1, is provided with well-known screw threads 1 providing a mounting into an incandescent socket. The lower portion of neck 2 has thick walls, within which are a pair of tubular holes 4 lined with conductive material for accepting the pin connectors 12 of a fluorescent lamp 13, as described below. At the central portion of lower neck 2, a cavity 5 is formed to accept the starter housing 3 of the fluorescent lamp 13.

The central portion 9 of base 6 accepts a conventional fluorescent lamp. The housing flares outwardly at base portion 6. At the peripheral portion of the base 6, an annular cavity 7 is provided to accept a ballast 8. The ballast is in electrical connection with both the socket formed on neck 1, and the tubular holes 4. The ballast provides electrical stability during operation of the lamp.

A washer-shaped cover 10 for the cavity 7 may be provided to protect a user from electrical shock or simply for aesthetic purposes. Preferably, instead of or in addition to a cover, the portion of the cavity 7 not occupied by the ballast 8 may be filled with a potting compound.

At the junction of base 6 and neck 2, six vents 11 are formed. The vents are located in a convective path of rising heated air. As shown in FIG. 2, the vents in the preferred embodiment are located at a portion of the adapter between the lamp base and the ballast. In operation, air between the ballast and the lamp base will be heated and will rise. As viewed in FIG. 1, air will rise and escape through the vents, drawing cool air from below, up into cavity 9 of the adapter. The location of the vents at a portion between the ballast and the lamp base allows convective cooling to dissipate heat generated both by the ballast and the lamp. Additionally, confining the path of the air between the lamp and the ballast increases the cooling ability of the moving air.

Thus, as previously described, the device of my invention operates at lower temperatures than conventional devices, thereby allowing higher wattage fluorescent lamps to be operated and extending the service life of both the fluorescent lamp and the adapter.

Although the dimensions of the device are not critical and can be varied to suit particular applications, dimensions which are acceptable for a wide variety of situations are as follows. The diameter of the lower portion of neck 2 may be 1.820 inches, and that of the portion which receives the starter housing, 0.970 inch. The length of the lower neck may be 1.225 inches. At the base of the lower neck, the housing flares at an angle of about 51 degrees from the horizontal until reaching a depth of about 1.8 inches. At that point, the angle of flare reduces to about 19 degrees from the horizontal, and the surface of the adapter the gradually curves downward to form the base of the housing.

The overall diameter of the base may be 4.200 inches and the overall length of the adapter, excluding the screw socket, about 3.075 inches.

The partition between the lamp mounting area and the ballast area is located, in the illustrated embodiment, at a radius of about 1.080 inches. The six vents are spaced approximately equally around the perimeter of the housing at a radius of about 0.950 inch, each vent being about 0.100 inch wide by about 0.350 inch long. FIG. 3 shows the adapter with lamp 13 in place with a generally conical reflector 18, which is similar to those typically used in ceiling light fixtures ("high hats"). Usually, the ceiling fixture will have a series of holes 14, for example, located at the upper portion thereof, to allow heat generated by an incandescent bulb to escape. Of course, any satisfactory air path out of the ceiling fixture can be used.

As shown in FIG. 3, reflector 18 is fitted into the adapter, for example, by means of a sliding fit at the inner walls of the ballast cavity 7. Suitable bonding can also be used to retain the reflector 18 in place. The close fit of the reflector and adapter allows conductive cooling of the adapter by the reflector and subsequent radiative cooling by the relatively large surface area of the reflector. Preferably, any bonding material used at this position should be heat-conductive, so as not to interfere with this radiative cooling. Cooling of the reflector is also facilitated by the passage of air over the reflector during operation of the adapter, as described below. Of course, heat conduction between the reflector and adapter may be improved with the use of any of a variety of thermal greases, for example, silicone jelly.

The operation of the assembly shown in FIG. 3 will now be described. As light is generated by the fluorescent lamp, air within the reflector is heated and begins to rise. Vents 11 form a path strategically located between the ballast and the base of the lamp through which heated air escapes and is expelled through holes 14. Heated air which has escaped is replaced by cool air 15 located below the reflector. The cool air absorbs and dissipates heat in the reflector and heat generated by the lamp and by the ballast. Thus heated, the replacement air also rises and escapes through vents 11 and holes 14. This creates a chimney effect indicated by arrows A, allowing heat to be effectively dissipated and allowing the device to operate at relatively lower temperatures.

If desired, the lower opening 16 in the reflector can be covered by a diffuser 17. Use of a diffuser may be mandated by aesthetic considerations, for example, where it is desired to shield the lamp so that the use of a non-incandescent rather than an incandescent lamp is not readily apparent. If such a diffuser is used, holes 19 are provided around the lower peripheral portion of the reflector to allow cool air to enter the reflector and provide the cooling effect.

A device according to the invention, substantially as illustrated in FIG. 3, was fabricated and tested. The adapter was operated continuously with a 28 watt fluorescent lamp for over 300 hours at an ambient temperature of 75 degrees F. The lamp operated satisfactorily throughout that period. The temperature at points X, Y and Z (FIG. 1) was measured near the end of that period, still during operation, with the following results:

X -<200 degrees F
Y -<237 degrees F
Z -<147 degrees F

These temperatures are within acceptable operational limitations of the fluorescent lamp utilized. Moreover, to my knowledge it had not previously been possible, without vents 11 and radiative cooling as provided by reflector 18, to achieve continuous operation of a 28 watt fluorescent lamp in an adapter sufficiently compact to permit the combination of adapter and lamp to be received in a high hat in the same space normally occupied by an incandescent lamp.

Although the illustrated embodiment is an adapter for enabling a fluorescent lamp to be used with a standard incandescent socket, the invention can also be embodied in other lighting fixtures, e.g., a hard-wired fixture rather than an adapter. Again, as indicated above, the fixture may be for use with a non-fluorescent lamp. It will also be understood that such matters as the exact number and placement of the vents and the other exact dimensions, can be varied without departing from the scope of the invention. Nor is the invention necessarily limited to an arrangement in which the lamp depends from the fixture, or in which the air follows a vertical, as opposed to an oblique, or even a horizontal, path in moving through the vent or vents.

While the preferred embodiment of the present invention, which incorporates the best mode of practicing this invention known to me, has been described above, the scope of this invention is not to be limited to any specific feature of the above embodiment, and instead should be ascertained by reference to the following claims.

What I claim is:

1. An apparatus for operating a lamp, said apparatus comprising:

a housing having a mounting for mounting the lamp, and a connector for electrically connecting a lamp mounted in said apparatus to a source of electrical power, said connector comprising electrical contacts for engaging contacts of the lamp;

a ballast compartment for receiving a reactive ballast for stabilizing power applied to the lamp; and cooling means comprising at least one vent disposed at a position intermediate said mounting and said ballast compartment to provide cooling to both the lamp and the reactive ballast during operation of the lamp.

2. An apparatus according to claim 1, wherein said vent is arranged to allow heated air to rise in path confined between said lamp and said ballast compartment.

3. An apparatus according to claim 1, wherein said ballast compartment, said mounting and said housing each have an axis of symmetry and said axes are mutually coincident, and said vent being disposed between said ballast compartment and said mounting.

4. An apparatus according to claim 1, wherein said mounting is adapted to mount a lamp of a type having a starter housing extending in one direction from a lamp base and an envelope through which light is emitted in operation extending in a second direction from the lamp base, said mounting defining a chamber for receiving the starter housing of the lamp; and wherein said chamber is displaced from said ballast compartment in a direction which coincides with the first direction of a lamp mounted in said mounting.

5. An apparatus according to claim 1, wherein said cooling means further comprises a thermally-conductive reflector joined to said housing in such a manner as to dissipate heat from the lamp radiatively.

6. An apparatus to claim 5 wherein said vent is arranged to allow heated air to move, and said reflector is disposed so as to confine the moving heated air to a path between said lamp and the ballast.

7. An apparatus for operating a lamp, said apparatus comprising:

a ballast for stabilizing power applied to operate the lamp;

a mounting in electrical contact with said ballast for mounting the lamp; and a housing having said ballast mounted therein, said housing including circulation means allowing air to circulate through said housing to a position passing both said ballast and the lamp to provide cooling during operation of the lamp.

8. An apparatus according to claim 7, wherein said circulation means comprises a vent disposed intermediate said ballast and said mounting and arranged to allow heated air to rise.

9. An apparatus according to claim 8, wherein said vent is disposed so as to allow the heated air to rise in a path confined between said ballast and the lamp.

10. An apparatus according to claim 7, further comprising a thermally-conductive reflector joined to said housing in such a manner as to dissipate heat from the lamp radiatively.

11. An apparatus according to claim 10, wherein said circulation means is arranged to allow heated air to move, and said reflector is arranged to confine the moving heated air to a path between said lamp and said ballast.

12. An apparatus according to claim 7, wherein said vent is disposed between said mounting and said ballast.

13. An apparatus for electrically and mechanically mounting a lamp, said apparatus comprising:

a connector for removably connecting said apparatus to a source of power;

a ballast electrically connected to said connector, said ballast stabilizing power applied to the lamp; and a housing joined to said connector and containing said ballast, said housing having a mounting in electrical contact with said ballast for mounting the lamp, and said housing including circulation means comprising at least one vent disposed at an intermediate portion of said housing between said ballast and said mounting for allowing air to circulate through said housing to dissipate heat.

14. An apparatus according to claim 13, wherein said ballast, said mounting and said housing each have an axis of symmetry and said axes are mutually coincident.

15. An apparatus according to claim 14, wherein said at least one vent is arranged to allow heated air to rise in a path confined between said lamp and said ballast.

16. An apparatus according to claim 13, further comprising a thermally-conductive reflector joined to said housing in such a manner as to dissipate heat from the lamp radiatively.

17. An apparatus according to claim 16, wherein said circulation means is arranged to allow heated air to move, and said reflector is arranged to confine the moving heated air to a path between said lamp and said ballast.

18. An apparatus for electrically and mechanically mounting a lamp and for directing light generated by the lamp, said apparatus comprising:

a generally conical reflector;

a housing to which said reflector is joined, said housing having a mounting for mounting the lamp;

a ballast disposed within said housing, said ballast stabilizing power applied to the lamp; and at least one vent defined at an intermediate position on said housing, said vent allowing air to be channeled through said housing past said ballast.

19. An apparatus according to claim 18, wherein said reflector has a diffuser for diffusing light produced by the lamp, said reflector defining at least one hole to permit passage of air between the interior and the exterior of said reflector.

20. An apparatus according to claim 18, wherein said reflector, said housing, said ballast and said mounting each have an axis and wherein said axes are mutually coincident, and said vent is disposed between said ballast and said mounting.

* * * * *